US011248327B2

(12) United States Patent
He et al.

(10) Patent No.: US 11,248,327 B2
(45) Date of Patent: Feb. 15, 2022

(54) COUNTERWEIGHT OF WASHING MACHINE, WASHING MACHINE, AND COUNTERWEIGHTING METHOD FOR WASHING MACHINE

(71) Applicant: GREE ELECTRIC APPLIANCES, INC. OF ZHUHAI, Guangdong (CN)

(72) Inventors: Can He, Guangdong (CN); Qi Li, Guangdong (CN); Yuzhou Yao, Guangdong (CN); Fuqi Situ, Guangdong (CN); Mingyu Chen, Guangdong (CN); Jianfu Zhong, Guangdong (CN)

(73) Assignee: Gree Electric Appliances, Inc. of Zhuhai, Zhuhai (CN)

( * ) Notice: Subject to any disclaimer, the term of this patent is extended or adjusted under 35 U.S.C. 154(b) by 386 days.

(21) Appl. No.: 16/329,575

(22) PCT Filed: Oct. 18, 2017

(86) PCT No.: PCT/CN2017/106680
§ 371 (c)(1),
(2) Date: Feb. 28, 2019

(87) PCT Pub. No.: WO2018/121008
PCT Pub. Date: Jul. 5, 2018

(65) Prior Publication Data

US 2019/0194854 A1 Jun. 27, 2019

(30) Foreign Application Priority Data

Dec. 26, 2016 (CN) ..... 201611219465.1

(51) Int. Cl.
*D06F 37/22* (2006.01)
*D06F 37/04* (2006.01)
(Continued)

(52) U.S. Cl.
CPC ..... *D06F 37/225* (2013.01); *D06F 33/48* (2020.02); *D06F 37/04* (2013.01); *D06F 39/001* (2013.01);
(Continued)

(58) Field of Classification Search
CPC ..... D06F 33/48; D06F 37/04; D06F 37/225; D06F 37/265; D06F 39/001; D06F 33/00;
(Continued)

(56) References Cited

U.S. PATENT DOCUMENTS 5,267,671 A * 12/1993 Baginski ..... D06F 39/024 222/154
5,870,907 A 2/1999 Cho
(Continued)

FOREIGN PATENT DOCUMENTS

CN 86207065 U 12/1987
CN 101 117 763 A 2/2008
(Continued)

OTHER PUBLICATIONS

Machine Translation of DE 102011087372 to Zhu et al., Jun. 2012. (Year: 2012).*
(Continued)

*Primary Examiner* — Benjamin L Osterhout
(74) *Attorney, Agent, or Firm* — McAndrews, Held & Malloy, Ltd.

(57) ABSTRACT

A counterweight of washing machine, a washing machine and a counterweighting method for the washing machine relates to the technical field of washing machines. The counterweight of washing machine includes at least one counterweight cavity and at least one pressured water structure; a water entering port for connecting a water entering pipeline and a water draining port for connecting a water draining pipeline are formed on a wall of each of the at least
(Continued)

one counterweight cavity; the at least one water pressurizing structure is disposed in each of the at least one counterweight cavity, and is configured to enable water entering each of the at least one counterweight cavity to be in an air-free sealed cavity. The counterweight of washing machine is mainly configured to reduce vibration and nose of the washing machine in work, and reduce the production and transportation cost of the washing machine.

20 Claims, 3 Drawing Sheets

(51) Int. Cl.

| | |
|---|---|
| ***D06F 39/00*** | (2020.01) |
| ***D06F 33/00*** | (2020.01) |
| ***D06F 33/48*** | (2020.01) |
| *D06F 103/00* | (2020.01) |
| *D06F 103/26* | (2020.01) |
| *D06F 103/38* | (2020.01) |
| *D06F 105/00* | (2020.01) |
| *D06F 105/02* | (2020.01) |
| *D06F 39/08* | (2006.01) |

(52) U.S. Cl.
CPC ..... *D06F 39/08* (2013.01); *D06F 2103/00* (2020.02); *D06F 2103/26* (2020.02); *D06F 2103/38* (2020.02); *D06F 2105/00* (2020.02); *D06F 2105/02* (2020.02)

(58) Field of Classification Search
CPC .. D06F 39/08; D06F 2103/38; D06F 2103/26; D06F 2105/02; D06F 2103/00; D06F 2202/085; D06F 2222/00; D06F 2105/00; D06F 2204/08
See application file for complete search history.

(56) References Cited

U.S. PATENT DOCUMENTS

| | | | | |
|---|---|---|---|---|
| 6,510,715 | B1 * | 1/2003 | Simsek | D06F 33/48 68/12.06 |
| 7,520,147 | B2 * | 4/2009 | Poloni | D06F 37/265 68/24 |
| 2008/0282746 | A1 * | 11/2008 | Komori | D06F 23/06 68/23.2 |
| 2016/0258508 | A1 * | 9/2016 | Ambrose | F16F 15/28 |
| 2017/0226681 | A1 * | 8/2017 | Lv | D06F 37/02 |

FOREIGN PATENT DOCUMENTS

| | | | | |
|---|---|---|---|---|
| CN | 106757989 | A | 5/2017 | |
| CN | 206359784 | U | 7/2017 | |
| DE | 19 02 325 | A1 | 11/1969 | |
| DE | 102011087372 | A1 * | 6/2012 | D06F 37/225 |
| EP | 2 607 540 | A1 | 6/2013 | |
| JP | 3404465 | B2 | 5/2003 | |

OTHER PUBLICATIONS

International Search Report, International Application No. PCT/CN2017/106680, dated Jan. 19, 2018.
The extended European search report for application No. EP17885739.7, dated Jun. 9, 2020, European Patent Office, Germany (8 pages).

* cited by examiner

COUNTERWEIGHT OF WASHING MACHINE, WASHING MACHINE, AND COUNTERWEIGHTING METHOD FOR WASHING MACHINE

CROSS-REFERENCE TO RELATED APPLICATIONS

The present disclosure is a 371 of International Patent Application No. PCT/CN/2017/106680, filed on Oct. 18, 2017, which claims priority to, is based upon, and claims benefit to Chinese Patent Application No. 201611219465.1, filed on Dec. 26, 2016 and entitled "COUNTERWEIGHT OF WASHING MACHINE, WASHING MACHINE AND COUNTERWEIGHTING METHOD FOR WASHING MACHINE", the contents of all of which are hereby incorporated by reference in their entirety.

TECHNICAL FIELD

The present disclosure relates to the technical field of washing machines, and in particular to a counterweight of a washing machine, the washing machine and a counterweighting method for the washing machine.

BACKGROUND

A counterweight of a washing machine plays a vital role in vibration adjustment of a roller washing machine. On one hand, the counterweight of the washing machine is configured to adjust a mass center of the roller washing machine; and on the other hand, the counterweight of the washing machine inhibits the vibration of the roller washing machine by increasing the mass of roller components (a water containing drum and an inner drum) of the roller washing machine. It is known by an inventor that the counterweight of the washing machine is a counterweight block composed of a solid material such as a cement or a metal.

Along with the improvement of people's living quality, the requirement of a user on vibration and noise of the roller washing machine is increasingly higher. While a technology of the roller washing machine is developed, the vibration and the noise of the roller washing machine are smaller and smaller. However, the mass of the corresponding counterweight of the washing machine on the roller washing machine is increasingly larger, and the mass of a counterweight of some roller washing machine even occupies 60% of the whole roller washing machine.

SUMMARY

It is recognized by the inventor that with the increase in the mass of a counterweight, the mass of a whole roller washing machine is increased directly and thus the roller washing machine is not transported and delivered conveniently. If the mass of the counterweight of the washing machine is directly reduced, not only is a weight reduction effect not obvious, but vibration and noise of the roller washing machine are also greatly improved and thus the user experience is directly affected.

In view of this, some embodiments of the present disclosure provide a counterweight of a washing machine, the washing machine and a counterweighting method for the washing machine, and is mainly intended to provide a mass adjustable counterweight of the washing machine to reduce vibration and noise of the washing machine.

To this end, the present disclosure mainly provides the following technical solutions.

In a first aspect, an embodiment of the present disclosure provides a counterweight of a washing machine, which is used on the washing machine and may include:

at least one counterweight cavity, wherein a water entering port for connecting a water entering pipeline and a water draining port for connecting a water draining pipeline are formed on a wall of each of the at least one counterweight cavity; and at least one water pressurizing structure, disposed in each of the at least one counterweight cavity, and configured to enable water entering each of the at least one counterweight cavity to be in an air-free sealed cavity.

The following technical measures may further be adopted to further implement the objective of the present disclosure and solve the technical problems thereof.

In an exemplary embodiment, each of the at least one water pressurizing structure may include:

a water pressurizing plate, wherein the water pressurizing plate is capable of being moved in each of the at least one counterweight cavity, and separates a cavity of each of the at least one counterweight cavity into a first cavity and a second cavity each having a changeable volume; and the water entering port and the water draining port respectively communicate with the first cavity; and a pressure assembly, configured to apply a pressure on the water pressurizing plate, so that the water pressurizing plate is moved toward a direction in which a volume of the first cavity is shrunk.

In an exemplary embodiment, the pressure assembly is disposed in the second cavity.

In an exemplary embodiment, when a pressure of the pressure assembly is zero, corresponding the counterweight cavity is in a water-free or a water-little state; when the counterweight cavity is in the water-free state, a volume of the first cavity is zero; and when the counterweight cavity is in a water entering state or a water storing state, the first cavity is a sealed cavity fully filled with the water.

In an exemplary embodiment, each of the pressure assembly includes a high pressure gas filled in the second cavity.

In an exemplary embodiment, each of the pressure assembly includes a spring.

In an exemplary embodiment, one end of the spring is connected with the water pressurizing plate, and the other end of the spring is connected with the wall of the counterweight cavity.

In an exemplary embodiment, the spring is a pressure spring or an arched plate spring.

In an exemplary embodiment, each of the at least one counterweight cavity is of an arc structure or an arch bridge shaped structure.

In an exemplary embodiment, an edge of the water pressurizing plate is in tight fit with the wall of the counterweight cavity.

In an exemplary embodiment, the at least one counterweight cavity includes a first counterweight cavity, a second counterweight cavity and a third counterweight cavity, wherein the first counterweight cavity is fixed on an upper end of a water containing drum of the washing machine; and the second counterweight cavity and the third counterweight cavity are fixed at two sides of the water containing drum of the washing machine.

In an exemplary embodiment, the water entering port of each of the at least one counterweight cavity is connected with the water entering pipeline, and the water draining port of each of the at least one counterweight cavity is connected with the water draining pipeline; a water entering valve is disposed on the water entering pipeline; and a water draining valve is disposed on the water draining pipeline.

In an exemplary embodiment, the counterweight of the washing machine may further include a water entering control device; and the water entering control device may include:

a water pressurizing plate displacement detector, configured to detect whether a water pressurizing plate in the counterweight cavity generates a displacement; and a controller, respectively connected with the water pressurizing plate displacement detector and the water entering valve;

wherein after the water entering valve is turned on, if the water pressurizing plate displacement detector detects that a displacement of the water pressurizing plate in the counterweight cavity is zero within a first set time period, a water injection stop signal is sent to the controller; and the controller controls the water entering valve to turn off according to a received signal.

In an exemplary embodiment, the counterweight of the washing machine may further include a water entering control device; and the water entering control device may include:

a water entering duration detector, configured to detect a water entering duration in each of the at least one counterweight cavity; and a controller, connected with the water entering duration detector and the water entering valve;

wherein when the water entering duration detector detects that the water entering duration of each of the at least one counterweight cavity is greater than a second set duration, a water injection stop signal is sent to the controller; and the controller controls the water entering valve to turn off according to a received signal; and wherein the second set duration is greater than a duration that each of the at least one counterweight cavity is fully filled with the water from the water-free state.

In a second aspect, an embodiment of the present disclosure provides a washing machine, which may include the counterweight of the washing machine in any item of the first aspect.

The following technical measures may further be adopted to further implement the objective of the present disclosure and solve the technical problems thereof.

In an exemplary embodiment, the washing machine may include a water containing drum; the counterweight of the washing machine and the water containing drum are fixed via a fastener; or the counterweight of the washing machine and the water containing drum are of an integral structure.

In an exemplary embodiment, the washing machine is a roller washing machine.

In a third aspect, an embodiment of the present disclosure provides a counterweighting method for a washing machine, which may be achieved by using the counterweight of the washing machine in any item of the first aspect to perform mass adjustable counterweighting on the washing machine, wherein when the washing machine works, water is injected to at least one counterweight cavity of the counterweight of the washing machine, so that the mass of the counterweight of the washing machine reaches its maximum; and when the washing machine needs to be moved or transported, water draining treatment is performed on the counterweight of the washing machine, so that each of the counterweight cavities of the counterweight of the washing machine is in a water-free state or a water-little state.

In an exemplary embodiment, the counterweight of the washing machine may include a water entering control device; and the water entering control device may include a water pressurizing plate displacement detector and a controller, and when the washing machine works, a water entering valve for controlling water entering port of each of the at least one counterweight cavity is turned on, and the water is injected to the at least one counterweight cavity of the counterweight of the washing machine; and when the water pressurizing plate displacement detector detects that a displacement of a water pressurizing plate in each of the at least one counterweight cavity is zero within a first set time period, a water injection stop signal is sent to the controller; and the controller controls the water entering valve to turn off according to a received signal.

In an exemplary embodiment, the counterweight of the washing machine may include a water entering control device; and the water entering control device may include a water entering duration detector and a controller, and when the washing machine works, the water entering valve for controlling the water entering port of each of the at least one counterweight cavity is turned on, and the water is injected to corresponding the counterweight cavity of the counterweight of the washing machine; and when the water entering duration detector detects that the water entering duration from each of the at least one counterweight cavity is greater than a second set duration, a water injection stop signal is sent to the controller; and the controller controls the water entering valve to turn off according to a received signal, wherein the second set duration is greater than a duration that each of the at least one counterweight cavity is filled with the water from the water-free state.

Compared with the related art, the counterweight of the washing machine, the washing machine and the counterweighting method for the washing machine provided by the disclosure at least have the following beneficial effects.

According to the counterweight of the washing machine provided by the embodiments of the present disclosure, with the adoption of the at least one counterweight cavity that takes the water as a counterweight medium and the water pressurizing structures disposed in the counterweight cavities, not only is the mass of the counterweight of the washing machine adjustable, but the cost of the counterweight of the washing machine is also reduced. When the washing machine works, the mass of the counterweight is large and the vibration inhibition effect is good. When the washing machine does not work, the mass of the counterweight may be reduced to transport and deliver conveniently. In addition, with the adoption of the water pressurizing structures provided by the counterweight of the washing machine in the embodiments of the present disclosure, water entering in the counterweight cavities always is in the air-free sealed cavity, so that the water is prevented from generating noise due to the existence of a large amount of water in the water storage counterweight cavities when the washing machine works, and the noise of the washing machine is further reduced.

Further, each of the at least one water pressurizing structure in the counterweight of the washing machine provided by the embodiments of the present disclosure includes the water pressurizing plate capable of being moved in each of the at least one counterweight cavity and the pressure assembly (such as the spring or the high pressure gas); each of the water pressurizing plates separates each of the counterweight cavities into the first cavity and the second cavity each having the changeable volume; and the pressure assemblies are disposed in the second cavities and apply a pressure for enabling the water pressurizing plates to move toward directions of the first cavities. With the above arrangement, the volume of each of the first cavities can be determined according to a water entering amount of each of the counterweight cavities, so that the entered water is fully filled in the first cavities all the time and the first cavities always are in the air-free state. When the counterweight of the washing machine works, the entered water in the counterweight of the washing machine can be prevented from generating the noise due to the existence of the large amount of air and at last the objective of reducing the noise of the washing machine is implemented.

Further, in the counterweight of the washing machine provided by the embodiments of the present disclosure, the pressure assembly in each of the at least one water pressurizing structure is set as the spring or the high pressure gas, so not only is the structure simple, but the first cavity in each of the at least one counterweight cavity is also in an air-free environment all the time, and thus the noise of the washing machine is further reduced.

In another aspect, the embodiments of the present disclosure further provide the washing machine. Since the washing machine includes the above-mentioned counterweight of the washing machine, the washing machine has the above beneficial effects, which will not be repeated one by one.

In a still another aspect, the embodiments of the present disclosure further provide the counterweighting method for the washing machine; and the counterweighting method is achieved by using the above-mentioned counterweight of the washing machine to perform the mass adjustable counterweighting on the washing machine and thus has the above beneficial effects, which will not be repeated one by one.

The above statements are merely an overview for the technical solutions of the present disclosure. In order that the technical means of the present disclosure can be known more clearly, the above statements may be implemented according to contents in the specification. The preferred embodiments of the present disclosure and detailed description of the accompanying drawings will be set forth hereinafter.

DETAILED DESCRIPTION OF THE EMBODIMENTS

In order to further describe the technical means and effects adopted to achieve a predetermined intended objective of the present disclosure, the detailed implementation manners, structures, characteristics and effects of the present disclosure will be described below in detail in combination with accompanying drawings and preferred embodiments. In the following description, a different "one embodiment" or "embodiments" unnecessarily refer to a same embodiment. In addition, specific characteristics, structures or features in one or more embodiments can be combined in any suitable form.

Figure 1:
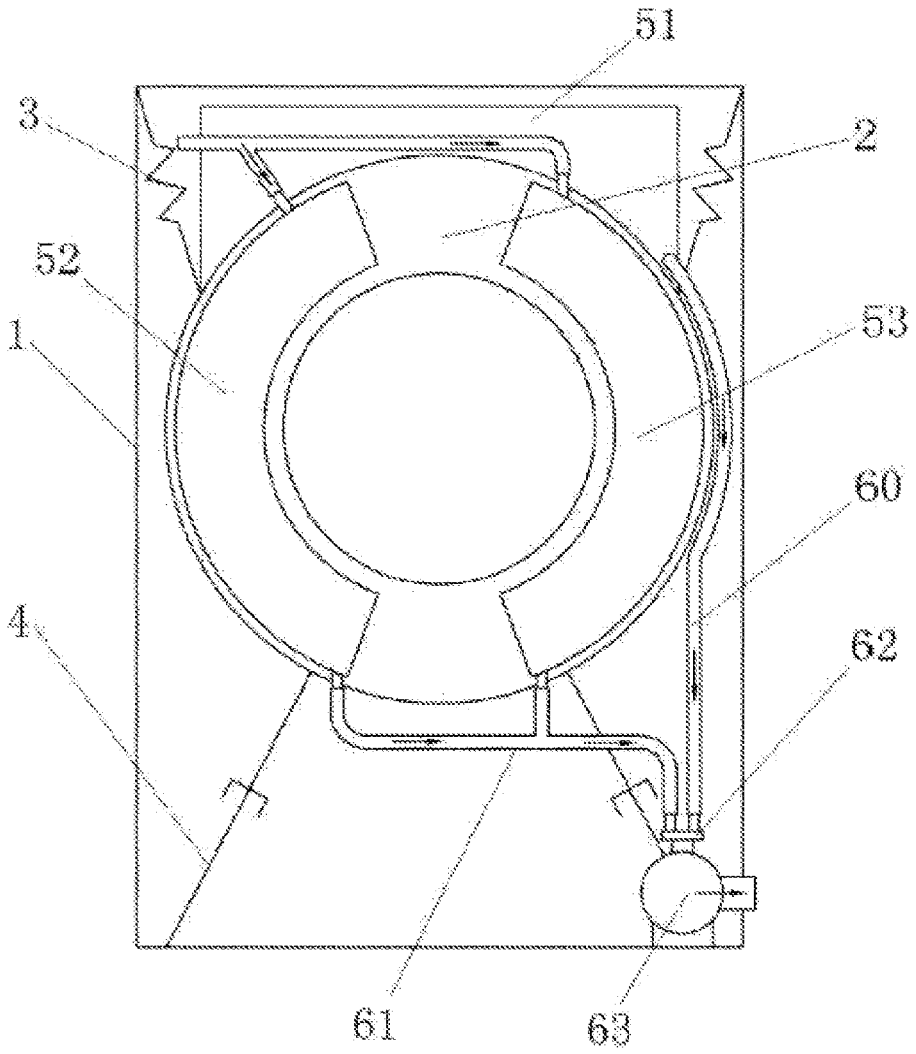
FIG. 1 is a front view of an internal structure of a washing machine provided by an embodiment of the present disclosure.
Figure 2:
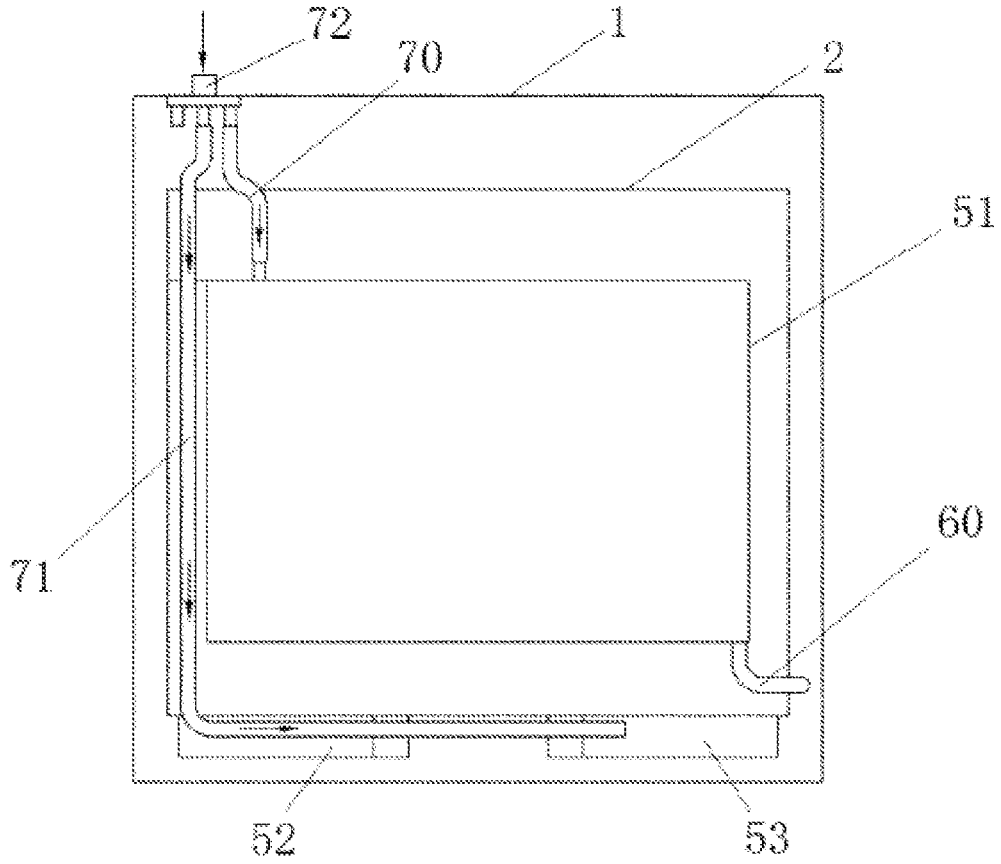
FIG. 2 is a top view of an internal structure of a washing machine provided by an embodiment of the present disclosure.
Figure 3:
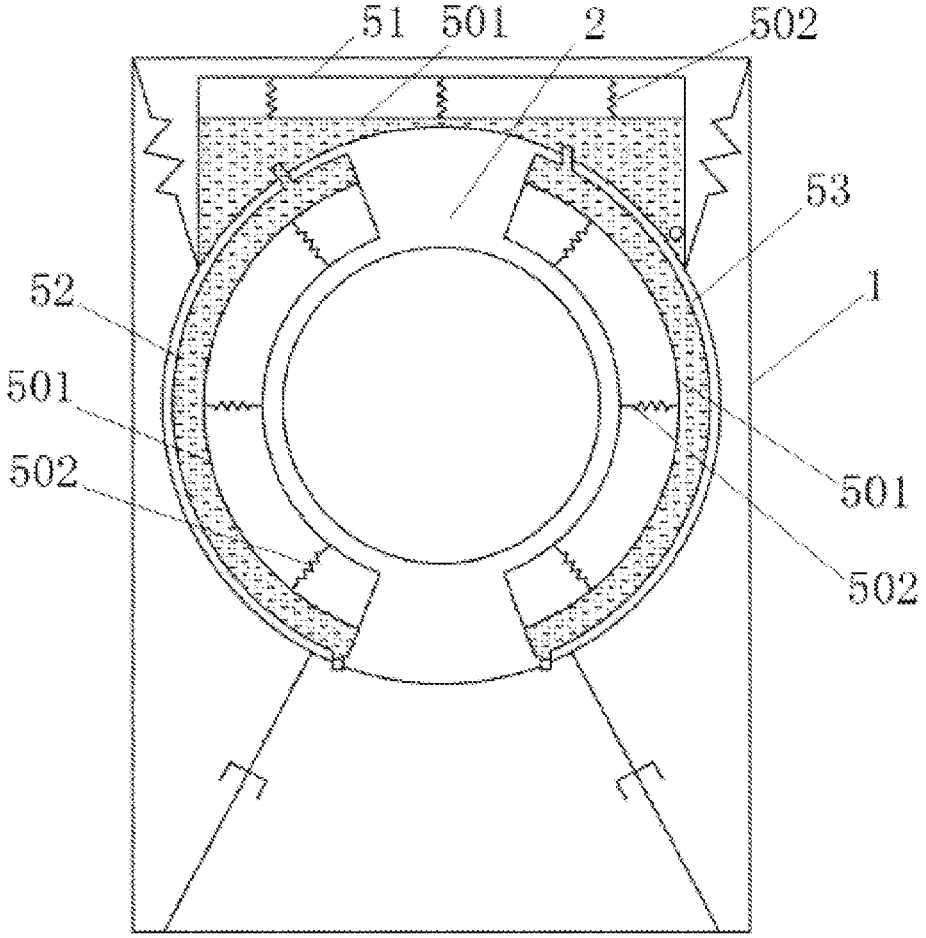
FIG. 3 is a sectional view of a counterweight of a washing machine in the washing machine provided by an embodiment of the present disclosure.

An embodiment of the present disclosure provides a counterweight of a washing machine, which is fixed on a water containing drum of the washing machine. With a roller washing machine as an example, the counterweight of the washing machine is mainly configured to adjust a mass center of a roller of the roller washing machine, and increase the mass of an outer drum (the water containing drum) and an inner drum of the roller washing machine, thereby inhibiting vibration of the roller washing machine. Specifically, as shown in FIG. 1 to FIG. 3, a counterweight of a washing machine may include at least one counterweight cavity (refer to a first counterweight cavity 51, a second counterweight cavity 52 and a third counterweight cavity 53 in FIG. 1 to FIG. 3) and water pressurizing structures (refer to a water pressurizing plates 501 and a springs 502 in FIG. 3). Each of the counterweight cavities is a sealed cavity; and a water entering port for connecting a water entering pipeline and a water draining port for connecting a water draining pipeline are formed on each of the counterweight cavities. Each of the water pressurizing structures is disposed in each of the counterweight cavities, and is configured to enable water entering each of the counterweight cavities to be in an air-free sealed cavity all the time.

The counterweight of the washing machine adopts the water as a counterweight medium, so that not only is the mass of the counterweight of the washing machine adjustable, but the cost of the counterweight of the washing machine is also reduced. When the counterweight of the washing machine is used on the washing machine, and the washing machine does not work, the mass of the counterweight of the washing machine may be close to zero, and thus the mass of the overall washing machine is greatly reduced, and the transportation and delivery cost is reduced. Besides, when the washing machine works, the mass of the counterweight of the washing machine may be very large, so that the objectives of adjusting the mass center of the roller of the roller washing machine and inhibiting the vibration of the roller washing machine are achieved, and the vibration and noise of the washing machine are reduced. Furthermore, for the counterweight of the washing machine, by providing the water pressurizing structure in each of the counterweight cavities, the water in each of the counterweight cavities is in an air-free state all the time, so the water in each of the counterweight cavities is prevented from generating the noise due to the existence of the air in each of the counterweight cavities when the washing machine works, and the noise of the washing machine is further reduced.

Each of the counterweight cavities in the foregoing embodiments and following embodiments of the present disclosure may be made of all plastic materials or metal materials for implementing functions of each of the counterweight cavities, such as a PP-GF30, a PC or a stainless steel.

Preferably, as shown in FIG. 3, each of the water pressurizing structures of the counterweight of the washing machine provided by some embodiments may include: a water pressurizing plate 501 and a pressure assembly. Each of the water pressurizing plates 501 is capable of being moved in each of the counterweight cavities, and separates the cavity of each of the counterweight cavities into a first cavity and a second cavity each having a changeable volume; the water entering ports and the water draining ports communicate with the first cavities; the first cavities and the second cavities are sealed cavities; and the pressure assemblies are disposed in the second cavities, and are configured to apply a pressure on the water pressurizing plates 501 so that the water pressurizing plates 501 are moved toward directions in which the volumes of the first cavities are shrunk. In these embodiments, the pressure refers to an elastic force of which the magnitude of the pressure is changed with the movement of each of the water pressurizing plates 501. In some more specific embodiments, the magnitude of the pressure is inversely proportional to the volume of each of the second cavities and is directly proportional to the volume of each of the first cavities.

In addition, in the counterweight of the washing machine provided by some embodiments of the present disclosure, when each of the counterweight cavities is in the water-free state, the volume of each of the first cavities is zero. When the pressure of each of the pressure assemblies reaches its maximum, the water is stopped from being filled to each of the counterweight cavities. When each of the counterweight cavities is in a water entering state or water storing state, each of the first cavities is a sealed cavity fully filled with the water. When the pressure of each of the pressure assemblies is zero, each of the counterweight cavities is in the water-free or a water-little state; and such a condition is set specifically according to the structure of each of the counterweight cavities and the pressure plates (for more details, refer to the following related contents).

With the above arrangement, the counterweight of the washing machine can determine the volume of each of the first cavities according to a water entering amount of each of the counterweight cavities, so that the water is fully filled in each of the first cavities all the time and each of the first cavities is always in the air-free state. When the counterweight of the washing machine works, the entered water in each of the counterweight cavities of the washing machine is prevented from generating the noise due to the existence of the large amount of air and at last the objective of reducing the noise of the washing machine is implemented.

Preferably, an edge of each of the water pressurizing plates 501 is in tight fit with the wall of each of the counterweight cavities so as to guarantee the sealing property of each of the first cavities.

Preferably, each of the pressure assemblies of the counterweight of the washing machine provided by some embodiments of the present disclosure may be set into the following structures.

First, each of the pressure assemblies in some embodiments of the present disclosure may be a high pressure gas filled in each of the second cavities.

Specifically, when each of the counterweight cavities of the counterweight of the washing machine is in the water-free state, the volume of each of the first cavities is zero, and the high pressure gas is fully filled in each of the counterweight cavities. When the water is injected into each of the counterweight cavities, the water pressurizing plates are moved towards directions in which the second cavities are shrunk under the action of a water pressure and the high pressure gas is compressed. The volume of each of the first cavities is increased continuously. When the high pressure gas is compressed to a limit, the water is stopped from entering. In the above process, the water entering of each of the counterweight cavities is performed in the air-free state of each of the first cavities. Therefore, the entered water in each of the counterweight cavities can be prevented from generating noise due to the large amount of air when the washing machine works.

Second, as shown in FIG. 3, each of the pressure assemblies in some embodiments of the present disclosure may be a spring 502 disposed in each of the second cavities. Preferably, one end of each of the springs 502 is connected with each of the water pressurizing plates 501, and the other end of each of the springs 502 is connected with the wall of each of the counterweight cavities. Preferably, each of the springs 502 may be a pressure spring 502 as shown in FIG. 3, and may also be an arched plate spring.

Specifically, when there is no water in each of the counterweight cavities of the counterweight of the washing machine, each spring 502 is in a free state or a compressed state. In a process when the water is continuously injected into each of the counterweight cavities, the water pressurizing plates are moved towards the directions in which the second cavities are shrunk under the action of the water pressure and the springs 502 are continuously compressed. When a compression amount of each of the springs 502 reaches its maximum, the water is stopped from entering. In the above process, the water entering of each of the counterweight cavities is performed in the air-free state of each of the first cavities. Therefore, the entered water in each of the counterweight cavities can be prevented from generating noise due to the large amount of air when the washing machine works.

Preferably, each of the counterweight cavities of the counterweight of the washing machine in some embodiments of the present disclosure is of an arc structure or an arch bridge shaped structure. Moreover, a place where each of the counterweight cavities is connected with the water containing drum of the washing machine is set into an arc surface or arched surface matched with the water containing drum of the washing machine.

As shown in FIG. 1 to FIG. 3, the counterweight cavities may include a first counterweight cavity 51, a second counterweight cavity 52 and a third counterweight cavity 53. With the roller washing machine as an example, the first counterweight cavity 51 is fixed at an upper end of the water containing drum of the washing machine (i.e., an outer drum of the roller washing machine), and the second counterweight cavity 52 and the third counterweight cavity 53 are fixed at two sides of the water containing drum of the washing machine (i.e., the second counterweight cavity 52 is a left counterweight cavity and the third counterweight cavity 53 is a right counterweight cavity). The second counterweight cavity 52 and the third counterweight cavity 53 are located at an inside of the inner drum and an outside of the outer drum of the water containing drum of the washing machine, and certainly may also be disposed at an outside of the water containing drum.

Preferably, the first counterweight cavity 51 is set into an arch bridge structure, and a place where the first counterweight cavity 51 is connected with the upper end of the water containing drum of the washing machine is set into an arched surface. Correspondingly, the pressure plate in the first counterweight cavity 51 is set into a flat-plate structure. In this way, when the spring 502 is restored to the free state, the volume of the first cavity is greater than zero. In order to prevent the air from entering the first cavity of the first counterweight cavity 51, the counterweight cavity is in the water-little state at this moment.

The second counterweight cavity 52 and the third counterweight cavity 53 are set into arc structures matched with the two sides of the water containing drum of the washing machine, and the places where the second counterweight cavity 52 and the third counterweight cavity 53 are connected with the water containing drum of the washing machine are set into arc surfaces. Correspondingly, the pressure plate in each of the second counterweight cavity 52 and the third counterweight cavity 53 may be set into the arc structure. When each of the springs 502 is restored to the free state, the volume of each of the first cavities is zero (i.e., each of the counterweight cavities is in the water-free state).

According to the counterweight of the washing machine provided by some embodiments of the present disclosure, through the above arrangement, not only is the space occupied by the counterweight of the washing machine in the washing machine reduced, but also the connection stability between the counterweight of the washing machine and the water containing drum is enhanced or the counterweight of the washing machine and the water containing drum are convenient to be molded together by injection.

Preferably, a water entering port of each of the counterweight cavities of the counterweight of the washing machine provided by some embodiments of the present disclosure is connected with a water entering pipeline, and a water draining port is connected with a water draining pipeline. A water entering valve is disposed on each of the water entering pipelines; and a water draining valve is disposed on each of the water draining pipelines.

Preferably, each of the water entering ports is provided with a water entering pipeline connector, and each of the water draining ports is provided with a water draining pipeline connector. The water entering pipelines and the water entering pipeline connectors are connected in clearance fit and are fixed via hoops; the water draining pipelines and the water draining pipeline connectors are connected in clearance fit and are fixed via hoops; the water entering pipelines and the water entering valve is connected in clearance fit and are fixed via hoops; and the water draining pipelines and the water draining valve is connected in clearance fit and are fixed via hoops.

For example, the counterweight cavities include three counterweight cavities. As shown in FIG. 1 and FIG. 2, water draining pipelines of the counterweight of the washing machine include a first water draining pipeline 60 and a second water draining pipeline 61; one end of the first water draining pipeline 60 communicates with the first counterweight cavity 51, and one end of the second water draining pipeline 61 communicates with the second counterweight cavity 52 and the third counterweight cavity 53 (herein, the second counterweight cavity 52 and the third counterweight cavity 53 share one water draining pipeline, and may also respectively adopt one water draining pipeline). The other end of the first water draining pipeline 60 and the other end of the second water draining pipeline 61 are connected with water draining valve 62, and the water draining valve 62 are connected with a master water draining valve 63 (herein, the connection between the water draining valve 62 and the master water draining valve 63 may be connection via clearance fit, and may also be connection via a rubber pipe and a hoop). The water entering pipelines of the counterweight of the washing machine include a first water entering pipeline 70 and a second water entering pipeline 71; one end of the first water entering pipeline 70 communicates with the first counterweight cavity 51, and one end of the second water entering pipeline 71 communicates with the second counterweight cavity 52 and the third counterweight cavity 53 (herein, two water entering pipelines may also be used to respectively communicate with the second counterweight cavity and the third counterweight cavity); and the other end of the first water entering pipeline 70 and the other end of the second water entering pipeline 71 communicate with water entering valve 72.

Preferably, the water entering pipelines and the water draining pipelines of the counterweight cavities in some embodiments of the present disclosure are made of a rubber, a silica gel or a plastic material such as an EPDM, and a PE+EVAC.

Preferably, the counterweight of the washing machine in some embodiments of the present disclosure may further include a water entering control device, which is mainly configured to judge whether each of the counterweight cavities is fully filled with the water so as to control the water entering valve to turn on and off. The water entering control device in some embodiments of the present disclosure may be designed into the following two structures.

The first design concept is to detect a displacement of each of the water pressurizing plates; and when a water pressurizing plate does not generate the displacement within a small period of time, it is considered that the water pressurizing plate is no longer moved and a water entering valve can be turned off.

Specifically, the water entering control device may include a water pressurizing plate displacement detector and a controller. The water pressurizing plate displacement detector is configured to detect whether each of the water pressurizing plates generates a displacement; the controller is respectively connected with the water pressurizing plate displacement detector and the water entering valve; after the water entering valve is turned on, if the water pressurizing plate displacement detector detects that a displacement of each of the water pressurizing plates is zero within a first set time period, a water injection stop signal is sent to the controller; and the controller controls the water entering valve to turn off according to a received signal. Preferably, the first set time period is 5 s to 2 min.

Herein, when the counterweight of the washing machine is provided with multiple counterweight cavities, water entering pipelines of the multiple counterweight cavities share one water entering valve and the water pressurizing plate displacement detector detects that displacements of all water pressurizing plates within the first set time period are zero, a water injection stop signal is sent to the controller.

A second design concept is to determine, via an experiment, a longest duration required to fully fill all counterweight cavities, and set a water charging time via a program so that the water charging time is greater than the longest duration determined via the experiment.

Specifically, the water entering control device may include a water entering duration detector and a controller. The water entering duration detector is configured to detect a water entering duration from each of the counterweight cavities. The controller is connected with the water entering duration detector and the water entering valve. When the water entering duration detector detects that the water entering duration from each of the counterweight cavities is greater than a second set duration, a water injection stop signal is sent to the controller; and the controller controls the water entering valve to turn off according to a received signal. The second set duration is greater than a duration that all counterweight cavities are filled with the water from the water-free state.

In another aspect, a washing machine is provided by some embodiments of the present disclosure. The washing machine may include the counterweight of the washing machine in the above any embodiment.

Preferably, the counterweight of the washing machine is an individual counterweight cavity, and is fixed with a water containing drum of the washing machine via a fastener (such as a buckle and a bolt). Or the counterweight cavity of the washing machine and an outer drum of the washing machine are moulded together by injection. An outer end surface of the counterweight of the washing machine is sealed by a cover plate and a rubber ring and is fastened by using a bolt, so as to prevent the counterweight of the washing machine from leaking water.

Preferably, as shown in FIG. 1 to FIG. 3, the washing machine in some embodiments of the present disclosure is a roller washing machine. The roller washing machine may include a frame 1 and roller components 2; the roller components 2 are disposed in the frame 1, and the roller components include an outer drum (i.e., the water containing drum) and an inner drum. The counterweight of the washing machine is fixed on the outer drum. For the roller washing machine, the counterweight of the washing machine is preferably provided with three counterweight cavities, i.e., a first counterweight cavity 51 (upper counterweight cavity), a second counterweight cavity 52 (left counterweight cavity) and a third counterweight cavity 53 (right counterweight cavity). For more details about the specific arrangement, refer to the above related description, which is not repeated herein. In addition, a size and a position of each of the counterweight cavities are designed in advance according to a mass distribution of a roller of a specific washing machine. According to a design requirement, counterweight cavities at other positions may also be increased, such as a lower counterweight cavity and a rear counterweight cavity.

Preferably, as shown in FIG. 1 to FIG. 3, a roller spring 3 and a damper 4 are further disposed in the roller washing machine.

Besides, when the washing machine provided by some embodiments of the present disclosure works and is transported, for more details about mass adjustment of the counterweight of the washing machine, refer to a counterweighting method of the washing machine described below.

In a still another aspect, a counterweighting method of a washing machine is provided in some embodiments of the present disclosure, which is mainly achieved by using the counterweight of the washing machine in previous any embodiment to perform mass adjustable counterweighting. The counterweighting method may specifically include the following steps.

First, when the washing machine works, the water is injected to counterweight cavities of the counterweight of the washing machine, so that the mass of the counterweight of the washing machine reaches its maximum.

This step may be implemented via the foregoing water entering control device. As shown in FIG. 1 and FIG. 2, the step may specifically include the following steps.

1) When the water entering control device includes a water pressurizing plate displacement detector: when the washing machine works, water entering valve 72 are turned on, and the water is injected to the counterweight cavities of the counterweight of the washing machine; and when the water pressurizing plate displacement detector detects that a displacement of a water pressurizing plate 501 in each of the at least one counterweight cavity is zero within a first set time period, a water injection stop signal is sent to the controller; and the controller controls the water entering valve 72 to turn off according to a received signal.

2) When the water entering control device includes a water entering duration detector: when the washing machine works, water entering valve 72 are turned on, and the water is injected to the counterweight cavities of the counterweight of the washing machine; and when the water entering duration detector detects that the water entering duration of each of the counterweight cavities is greater than a second set duration, a water injection stop signal is sent to the controller; and the controller controls the water entering valve 72 to turn off according to a received signal.

The step is detailed as follows: as shown in FIG. 1 to FIG. 3, before the washing machine is used, water draining valve 62 of the counterweight of the washing machine are an off state; and at this moment, the counterweight cavities are in a water-free or a water-little state, an elongation of a spring in each of the water pressurizing plates 501 reaches its maximum and each of the water pressurizing plates 501 is at an initial position. When a washing machine system automatically or manually starts a water entering program for the counterweight of the washing machine, the water entering valve 72 are turned on, and at this moment, the water enters the counterweight cavities along water entering pipelines. In the process when the water is gradually filled into the counterweight cavities, the water pressurizing plates 501 are moved towards directions in which the springs 502 are compressed under the action of the water, and at this moment, the springs 502 are compressed slowly. When each of the springs 502 are compressed to a limit position and each of the water pressurizing plates 502 cannot be moved continuously, the water entering valve 72 are turned off and the water is stopped from being injected to the counterweight cavities.

Second, when the washing machine needs to be transported or delivered, water draining treatment is performed on the counterweight of the washing machine, so that the counterweight cavities of the counterweight of the washing machine are in the water-free state or a water-little state. Preferably, the step specifically is as follows.

1) The washing machine and the water entering pipelines of the washing machine are disconnected; and 2) the water entering valve on the water entering pipelines and the water draining valve on the water draining pipelines of the counterweight of the washing machine are turned on, so that the water in the counterweight cavities of the counterweight of the washing machine is drained along the water draining pipelines under the action of a gravity.

The step is detailed as follows: as shown in FIG. 1 to FIG. 3, when the washing machine needs to be moved, transported or delivered, a water draining program of the counterweight of the washing machine is started manually, and at this moment, the washing machine is not connected with the water entering pipes of the washing machine. After the program is started, the water entering valve 72 and the water draining valve 62 are Limed on completely (in order to prevent the water from leaking from the water entering valve 72, when the counterweight cavities of the counterweight of the washing machine are designed, highest liquid levels are not beyond the water entering valve respectively, or a one-way water entering valve is adopted to prevent water leakage), the water in the counterweight cavities are flowed to the water draining pipes of the washing machine along the water draining pipelines under the action of the gravity and then is drained via the water draining pipes of the washing machine. After the water in the counterweight cavities is drained completely, the water entering valve and the water draining valve is turned off. At this moment, the counterweight cavities are in the water-free or a water-little state, so that the mass of the whole washing machine is greatly reduced, thereby being convenient for subsequent movement and transportation.

In conclusion, according to the counterweight of the washing machine, the washing machine and the counterweighting method for the washing machine provided by the embodiment of the present disclosure, the counterweight of the washing machine is provided with at least one counterweight cavity, and the water pressurizing structure is disposed in each of the at least one counterweight cavity, so that the water entering the counterweight cavities is in the air-free sealed cavity. Consequently, the counterweight of the washing machine and the mass of the washing machine are adjustable, the vibration and noise of the washing machine in work are reduced, and the production and transportation cost of the washing machine is reduced.

It is easily understood by a person skilled in the art that the above implementation manners may be freely combined and overlapped if there is no conflict.

The above are only preferred embodiments of the present disclosure and are not intended to form a limit to the present disclosure in any form. Any simple alteration, equivalent change and modification made to the above embodiments according to a technical essence of the present disclosure still pertain to a scope of the technical solutions of the present disclosure.

What is claimed is:

1. A counterweight of a washing machine, comprising:

at least one counterweight cavity, wherein a water entering port for connecting a water entering pipeline and a water draining port for connecting a water draining pipeline are formed on a wall of each of the at least one counterweight cavity; and at least one water pressurizing structure, disposed in each of the at least one counterweight cavity, and configured to enable water entering each of the at least one counterweight cavity to be in an air-free sealed cavity.

2. The counterweight of the washing machine as claimed in claim 1, wherein each of the at least one water pressurizing structure comprises:

a water pressurizing plate, wherein the water pressurizing plate is capable of being moved in each of the at least one counterweight cavity, and separates a cavity of each of the at least one counterweight cavity into a first cavity and a second cavity each having a changeable volume; and the water entering port and the water draining port respectively communicate with the first cavity; and a pressure assembly, configured to apply a pressure on the water pressurizing plate, so that the water pressurizing plate is moved toward a direction in which a volume of the first cavity is shrunk.

3. The counterweight of the washing machine as claimed in claim 2, wherein the pressure assembly is disposed in the second cavity.

4. The counterweight of the washing machine as claimed in claim 2, wherein when a pressure of the pressure assembly is zero, corresponding the counterweight cavity is in a water-free or a water-little state;

when the counterweight cavity is in the water-free state, a volume of the first cavity is zero; and when the counterweight cavity is in a water entering state or a water storing state, the first cavity is a sealed cavity fully filled with the water.

5. The counterweight of the washing machine as claimed in claim 2, wherein the pressure assembly comprises a high pressure gas filled in the second cavity.

6. The counterweight of the washing machine as claimed in claim 2, wherein the pressure assembly comprises a spring.

7. The counterweight of the washing machine as claimed in claim 6, wherein one end of the spring is connected with the water pressurizing plate, and the other end of the spring is connected with the wall of the counterweight cavity.

8. The counterweight of the washing machine as claimed in claim 6, wherein the spring is a pressure spring or an arched plate spring.

9. The counterweight of the washing machine as claimed in claim 1, wherein each of the at least one counterweight cavity is of an arc structure or an arch bridge shaped structure.

10. The counterweight of the washing machine as claimed in claim 2, wherein an edge of the water pressurizing plate is configured to apply pressure to the wall of the counterweight cavity.

11. The counterweight of the washing machine as claimed in claim 1, wherein the at least one counterweight cavity comprises a first counterweight cavity, a second counterweight cavity and a third counterweight cavity, wherein the first counterweight cavity is fixed on an upper end of a water containing drum of the washing machine; and the second counterweight cavity and the third counterweight cavity are fixed at two sides of the water containing drum of the washing machine.

12. The counterweight of the washing machine as claimed in claim 1, wherein the water entering port of each of the at least one counterweight cavity is connected with the water entering pipeline, and the water draining port of each of the at least one counterweight cavity is connected with the water draining pipeline; a water entering valve is disposed on the water entering pipeline; and a water draining valve is disposed on the water draining pipeline.

13. The counterweight of the washing machine as claimed in claim 12, wherein the counterweight of the washing machine further comprises a water entering control device; and the water entering control device comprises:

a water pressurizing plate displacement detector, configured to detect whether a water pressurizing plate in the counterweight cavity generates a displacement; and a controller, respectively connected with the water pressurizing plate displacement detector and the water entering valve;

wherein after the water entering valve is turned on, if the water pressurizing plate displacement detector detects that a displacement of the water pressurizing plate in the counterweight cavity is zero within a first set time period, a water injection stop signal is sent to the controller; and the controller controls the water entering valve to turn off according to a received signal.

14. The counterweight of the washing machine as claimed in claim 13, wherein the counterweight of the washing machine further comprises a water entering control device; and the water entering control device comprises:

a water entering duration detector, configured to detect a water entering duration in each of the at least one counterweight cavity; and a controller, connected with the water entering duration detector and the water entering valve;

wherein when the water entering duration detector detects that the water entering duration of each of the at least one counterweight cavity is greater than a second set duration, a water injection stop signal is sent to the controller; and the controller controls the water entering valve to turn off according to a received signal; and wherein the second set duration is greater than a duration that each of the at least one counterweight cavity is fully filled with the water from the water-free state.

15. A washing machine, comprising the counterweight of the washing machine as claimed in claim 1.

16. The washing machine as claimed in claim 15, wherein the washing machine comprises a water containing drum;

the counterweight of the washing machine and the water containing drum are fixed via a fastener; or the counterweight of the washing machine and the water containing drum are of an integral structure.

17. The washing machine as claimed in claim 15, wherein the washing machine is a roller washing machine.

18. A counterweighting method for a washing machine, being achieved by using the counterweight of the washing machine as claimed in claim 1 to perform mass adjustable counterweighting on the washing machine, wherein when the washing machine works, water is injected to at least one counterweight cavity of the counterweight of the washing machine, so that the mass of the counterweight of the washing machine reaches its maximum; and when the washing machine needs to be moved or transported, water draining treatment is performed on the counterweight of the washing machine, so that each of the at least one counterweight cavities of the counterweight of the washing machine is in a water-free state or a water-little state.

19. The counterweighting method for the washing machine as claimed in claim 18, wherein the counterweight of the washing machine comprises a water entering control device; the water entering control device comprises a water pressurizing plate displacement detector and a controller; and when the washing machine works, a water entering valve for controlling the water entering port of each of the at least one counterweight cavity is turned on, and the water is injected to the at least one counterweight cavity of the counterweight of the washing machine; and when the water pressurizing plate displacement detector detects that a displacement of a water pressurizing plate in each of the at least one counterweight cavity is zero within a first set time period, a water injection stop signal is sent to the controller; and the controller controls the water entering valve to turn off according to a received signal.

20. The counterweighting method for the washing machine as claimed in claim 18, wherein the counterweight of the washing machine comprises a water entering control device; the water entering control device comprises a water entering duration detector and a controller; and when the washing machine works, a water entering valve for controlling the water entering port of each of the at least one counterweight cavity is turned on, and the water is injected to the corresponding counterweight cavity of the counterweight of the washing machine; and when the water entering duration detector detects that a water entering duration from each of the at least one counterweight cavity is greater than a second set duration, a water injection stop signal is sent to the controller; and the controller controls the water entering valve to turn off according to a received signal, wherein the second set duration is greater than a duration that each of the at least one counterweight cavity is filled with the water from the water-free state.

* * * * *